US005960240A

United States Patent [19]

Ida et al.

[11] Patent Number: 5,960,240

[45] Date of Patent: Sep. 28, 1999

[54] ELECTROPHOTOGRAPHIC PRINTER

[75] Inventors: Koji Ida; Toyokazu Shiraishi, both of Tokyo, Japan

[73] Assignee: Oki Data Corp., Tokyo, Japan

[21] Appl. No.: 09/143,348

[22] Filed: Aug. 28, 1998

[30] Foreign Application Priority Data

Aug. 29, 1997 [JP] Japan ..... 9-249610

[51] Int. Cl.[6] ..... G03G 15/16

[52] U.S. Cl. ..... 399/296

[58] Field of Search ..... 399/296, 127, 399/128, 299, 186, 187, 188, 190, 191; 347/130, 131

[56] References Cited

U.S. PATENT DOCUMENTS

| | | | |
|---|---|---|---|
| 4,797,707 | 1/1989 | Iwahashi et al. | 399/43 |
| 5,250,963 | 10/1993 | Smith et al. | 347/130 |
| 5,585,906 | 12/1996 | Takahashi et al. | 399/296 |

*Primary Examiner*—William Royer
*Assistant Examiner*—Greg Moldafsky
*Attorney, Agent, or Firm*—Rabin & Champagne PC

[57] ABSTRACT

An electrophotographic printer includes a rotating photoconductive drum, a developing unit, a transfer roller, and a neutralizer. The neutralizer neutralizes a second area of the surface of the photoconductive drum different from a second area in which the toner is applied. A sensor may be provided along the transport path to detect a leading end and a trailing end of the print medium passing along the transport path. In accordance with the sensor output, the neutralizer neutralizes the second area (i.e., top margin and bottom margin) on the photoconductive drum adjacent the leading end and the trailing end of the print medium. A neutralization data generator may be added. The neutralization data generator searches the bit map data for dots which should be printed, and produces neutralization data on the basis of the dots. Then, the neutralizer illuminates only the second area (i.e., areas in which toner is absent) in accordance with the neutralization data. The neutralization data generator inverts bit map data produced by a controller to produce the neutralization data and the neutralizer includes light emitting elements energized in accordance with the neutralization data to illuminated the area in which toner is absent. The neutralization data generator produces the neutralization data such that there is a buffer area surrounding the first area having a predetermined width. The buffer area is not neutralized.

11 Claims, 17 Drawing Sheets

FIG.9

| TIME | TRAVELED DISTANCE | ELAPSED TIME |
|---|---|---|
| $t_1$ | $-L_1$ | $T_1 = -L_1/S$ |
| $t_2$ | 0 | 0 |
| $t_3$ | $L_2-L_1$ | $T_2 = (L_2-L_1)/S$ |
| $t_4$ | $L_2$ | $T_5 = L_2/S$ |
| $t_5$ | $L_2*2-L_1$ | $T_3 = (L_2*2-L_1)/S$ |
| $t_6$ | $L_2*2$ | $T_6 = (L_2*2)/S$ |
| $t_7$ | $L_2*3-L_1$ | $T_4 = (L_2*3-L_1)/S$ |
| $t_8$ | $L_2*3$ | $T_7 = (L_2*3)/S$ |
| $t_9$ | $-L_1$ | $T_8 = -L_1/S$ |
| $t_{10}$ | 0 | 0 |
| $t_{11}$ | $L_2-L_1$ | $T_9 = (L_2-L_1)/S$ |
| $t_{12}$ | $L_2$ | $T_{12} = L_2/S$ |
| $t_{13}$ | $L_2*2-L_1$ | $T_{10} = (L_2*2-L_1)/S$ |
| $t_{14}$ | $L_2*2$ | $T_{13} = (L_2*2)/S$ |
| $t_{15}$ | $L_2*3-L_1$ | $T_{11} = (L_2*3-L_1)/S$ |
| $t_{16}$ | $L_2*3$ | $T_{14} = (L_2*3)/S$ |

$T_1 \sim T_{14}$: ELAPSED TIME $t_1 \sim t_8$ : TIMES AT WHICH LEADING END OF MEDIUM PASSES CORRESPONDING LOCATIONS $t_9 \sim t_{16}$ : TIMES AT WHICH TRAILING END OF MEDIUM PASSES CORRESPONDING LOCATIONS

S : SPEED OF TRAVEL OF MEDIUM $L_2$ : DISTANCE BETWEEN PRINT ENGINES $L_1$ : DISTANCE FROM TRANSFER POINT Pt

3RD LINE

4TH LINE

5TH LINE

FIG.20A

1ST LINE : 1111111111111
2ND LINE : 1111111111111
3RD LINE : 1111111111111

FIG.20B

2ND LINE : 1111100011111
3RD LINE : 1111100011111
4TH LINE : 1111100011111

FIG.20C

3RD LINE : 1111000001111
4TH LINE : 1111000001111
5TH LINE : 1111000001111

FIG.20D

4TH LINE : 1110001000111
5TH LINE : 1110001000111
6TH LINE : 1110001000111

FIG.20E

3RD LINE OF FIG. 20A → 1111111111111
3RD LINE OF FIG. 20B → 1111100011111
3RD LINE OF FIG. 20C → 1111000001111
↓ AND
1111000001111

FIG.20F

4TH LINE OF FIG. 20B → 1111100011111
4TH LINE OF FIG. 20C → 1111000001111
4TH LINE OF FIG. 20D → 1110001000111
↓ AND
1110000000111

ELECTROPHOTOGRAPHIC PRINTER

BACKGROUND OF THE INVENTION

1. Field of the Invention

The present invention relates to an electrophotographic printer which performs a reliable transfer operation.

2. Description of the Related Art

An electrophotographic printer involves the following sequence of operations. The electrostatic latent image is formed by first charging the surface of a photoconductive drum and then exposing the charged surface to a light pattern. The latent image is then developed with toner, transferred to a print medium such as paper, and then fused to the paper. A tandem type color electrophotographic printer includes a plurality of photoconductive drums spaced apart along the path of a print medium, so that yellow, magenta, cyan, and black images are transferred in registration with each other and fused on the print medium. A tandem type color electrophotographic printer provides higher printing speed than a single drum type color electrophotographic printer where a single drum is subjected to repeated image production processes to print images of different colors. A further advantage of the tandem type color electrophotographic printer is that the conveyer belt can be made substantially flat, and lends itself to printing on a thick print medium.

The conventional electrophotographic printer suffers the following drawbacks.

A transfer electric field is selected so that the entire toner image can be properly transferred to the print medium. The transfer electric field is significantly influenced by characteristics such as impedances of the transfer rollers, print medium, and photoconductive drums. With the tandem type electrophotographic printer, a conveyer belt runs between the transfer roller and the photoconductive drum at each print engine. Thus, a small amount of current flows through the conveyer belt, affecting the transfer electric field. A low impedance at a location where the transfer operation takes place causes a large transfer current to flow and a small change in impedance causes a significant change in transfer electric field. Thus, some measure should be taken in order to increase the impedance at the location where the transfer operation takes place. A technique has been proposed where the surface of the photoconductive drum is exposed to light for neutralizing the charged surface immediately before the transfer operation takes place. However, exposing the entire drum surface to the light causes a developed toner image to loose its adhesion to the drum surface, deteriorating the reproducibility and resolution of the image.

SUMMARY OF THE INVENTION

An electrophotographic printer includes a rotating photoconductive drum, a developing unit, a transfer roller, and a neutralizer. The transfer roller transfers the toner image to a print medium when the print medium travels along a transport path past a transfer point where the print medium is sandwiched between the photoconductive drum and the transfer device. The neutralizer is provided downstream of the developer and upstream of the transfer roller. The neutralizer neutralizes a second area of the surface of the photoconductive drum, different from a first area in which the toner is applied.

The electrophotographic printer may include a non-print region detecting section provided along the transport path. The non-print region detecting section outputs a detection signal upon having detected a leading end and a trailing end of the print medium passing along the transport path. The neutralizer then neutralizes the second area (i.e., top margin and bottom margin) on the photoconductive drum adjacent the leading end and the trailing end of the print medium in accordance with the detection signal.

The electrophotographic printer may include a neutralization data generator. The neutralization data generator searches the bit map data for dots which should be printed, and produces neutralization data on the basis of the dots. Then, the neutralizer illuminates only the second area (i.e., areas in which toner is absent) in accordance with the neutralization data. The neutralization data generator inverts the bit map data produced by a controller to produce the neutralization data and the neutralizer includes light emitting elements energized in accordance with the neutralization data to illuminate the area in which toner is absent.

The neutralization data generator produces the neutralization data such that there is a buffer area surrounding the first area having a predetermined width. The buffer area is not neutralized.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 9 is a table which lists the times at which the leading end and trailing end of the print medium pass the various locations along the transport path;

FIGS. 20A–20C illustrate the digital representations of the 3rd to 5th lines after expanding in vertical, horizontal, and diagonal directions;

FIG. 20D shows the digital representation of the 2nd line; and

FIGS. 20E and 20F illustrate ultimate neutralization data.

DETAILED DESCRIPTION OF THE INVENTION

The present invention will be described in detail with respect to the accompanying drawings.

First Embodiment

Figure 1:
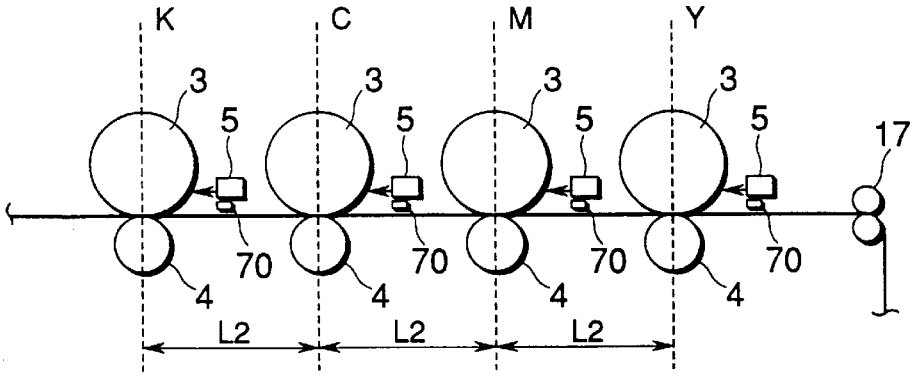
FIG. 1 illustrates a general construction of a tandem type electrophotographic printer.

FIG. 1 illustrates a general construction of a tandem type photographic printer.

Figure 2:
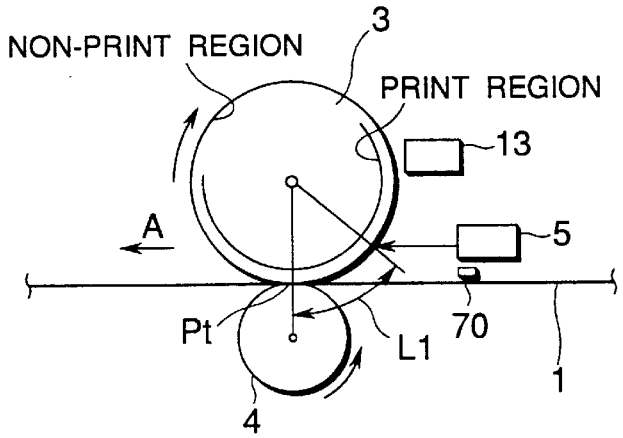
FIG. 2 is an enlarged view of one of the print engines of FIG. 1.

Referring to FIGS. 1 and 2, in which FIG. 2 is an enlarged view of one of the print engines of FIG. 1, a print medium 1 travels in a direction shown by arrow A through print engines for yellow, magenta, cyan, and black, which are aligned in this order at predetermined intervals L2. Disposed around each photoconductive drum 3 is are a developing unit 13, transfer roller 4, and neutralizer 5.

The neutralizer 5 illuminates the photoconductive drum 3 a distance L1 away from a transfer point Pt on the photoconductive drum where the transfer of the image takes place. The distances L1 and L2 are parameters used in controlling a neutralization operation in the present invention, which will be described later. The print medium 1 travels from right to left in FIGS. 1–3, so that the toner image of a corresponding color is transferred from the photoconductive drum 3 to the print medium 1 at each print engine. In this specification, the term "print region" is used to cover an area (PR in FIG. 12) on the photoconductive drum 3 where a toner image is formed and the term "non-print region" is used to cover an area (NPR1, NPR2, NPR3 in FIG. 12) on the photoconductive drum 3 where no toner image is formed. The neutralizer 5 illuminates only the non-print regions. The term "non-print region" also covers areas on the photoconductive drum 3 corresponding to areas between the adjacent pages of print medium.

Figure 3:
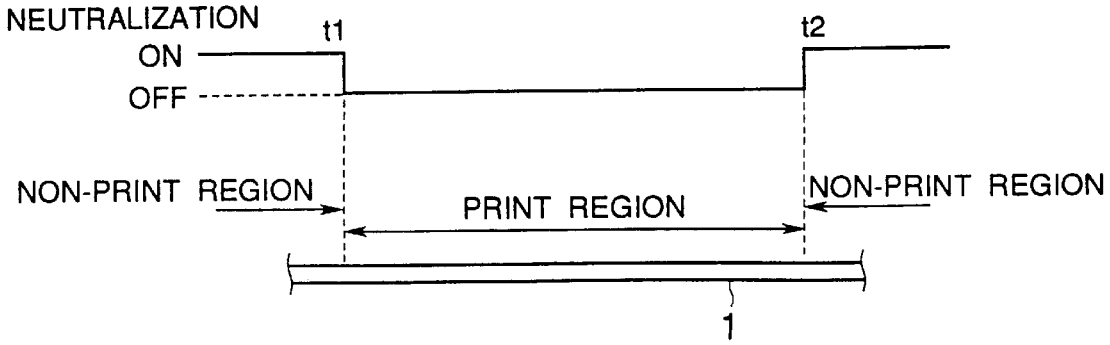
FIG. 3 is a timing chart illustrating a neutralization operation.

FIG. 3 is a timing chart illustrating the neutralization operation. The neutralization operation is performed before time t1 and after time t2. In other words, the neutralizer 5 does not illuminate the print region of the photoconductive drum 3 for a length of time from time t1 to time t2.

Figure 4:
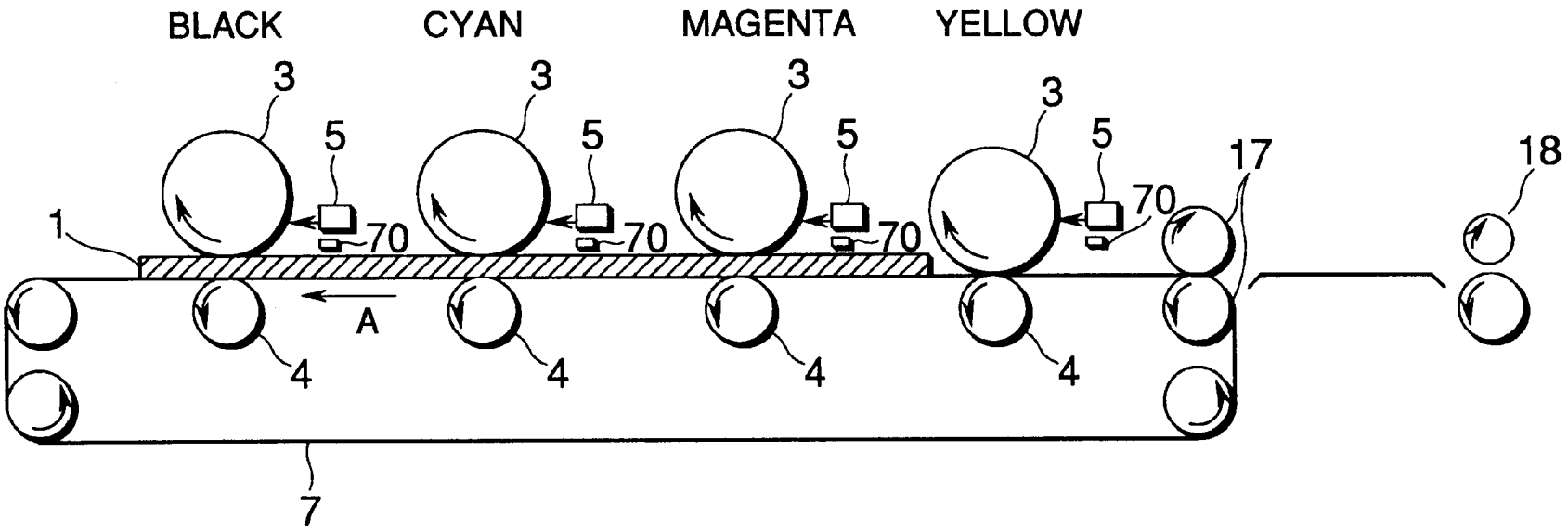
FIG. 4 is a cross-sectional view of a tandem type printer.

FIG. 4 is a side view of a tandem type printer. Referring to FIG. 4, there are provided a yellow print engine, a magenta print engine, a cyan print engine, and a black print engine, aligned in this order from right to left. The print medium 1 is transported from right to left on the conveyer belt 7 which runs in a loop-like path in a direction shown by arrow A. Attraction rollers 17 hold the leading edge of the print medium 1 therebetween so as to hold the print medium 1 in intimate contact with the conveyer belt 7. Then, the leading edge of the print medium 1 is second pulled in between the photoconductive drum 3 and the transfer roller 4 of the yellow print engine. After the yellow toner image has been transferred to the print medium 1, the print medium 1 is advanced to the magenta print engine.

Likewise, the magenta, cyan, and black toner images are transferred on the print medium 1 as the print medium 1 passes through the corresponding print engines. Accurately detecting the timing at which the print medium 1 passes the attraction rollers 17 permits determining of the location of the leading end of the print medium 1 along the transport path, thereby operating the respective neutralizers 5 at appropriate timings.

A registry roller 18 (FIG. 4) is provided to control the timing at which the print medium 1 is delivered to the print engines. The print medium 1 is temporarily stopped by the registry roller 18 for a short time just before the transfer operation takes place, so that the print medium 1 is advanced in synchronism with the rotation of the photoconductive drum 3. This way of synchronizing the rotation of photoconductive drum 3 with the position of print medium 1 has been well known.

A sensor 70 is provided along the transport path between attraction rollers 17 and the transfer roller 4. In accordance with the output of the sensor 70, the timings are accurately detected at which the leading end and trailing end of the print medium 1 pass the transfer point Pt between the photoconductive drum 3 and the transfer roller 4 at each print engine. The output of the sensors 70 are also used to determine the non-print region on the photoconductive drum 3 between adjacent pages of print medium.

Figure 5:
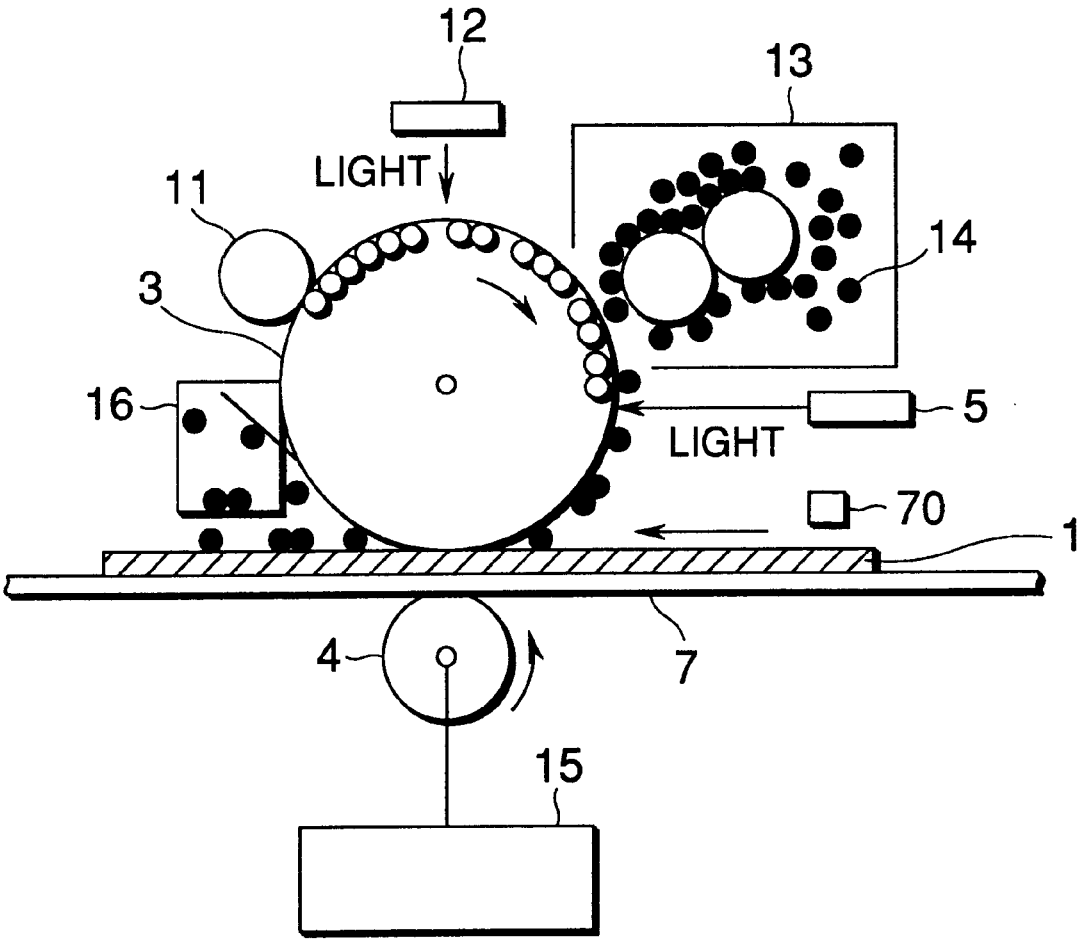
FIG. 5 illustrates a relevant portion of the printer.

FIG. 5 illustrates a relevant portion of one of the print engines.

The aforementioned operation will be described in more detail with reference to FIG. 5.

Referring to FIG. 5, this print engine includes a charging roller 11, exposing unit 12, developing unit 13, neutralizer 5, transfer power supply 15, cleaning unit 16, which are disposed along the rotation path of the photoconductive drum 3. The print medium 1 is transported on the conveyer belt 7 from right to left in FIG. 5, and passes the transfer point Pt between the photoconductive drum 3 and the transfer roller 4. The transfer power supply 15 is a direct current power supply that supplies a predetermined transfer electric field to the transfer roller 4.

The surface of the photoconductive drum 3 is charged by the charging roller 11 to a predetermined potential as depicted by white circles, and the exposing unit 12 illuminates the charged surface in accordance with an image to be printed, thereby forming an electrostatic latent image on the photoconductive drum 3. The electrostatic latent image is then developed with toner 14 by the developing unit 13 into a toner image. The toner image is transferred by the transfer roller 4 to the print medium 1. Then, the print medium 1 is further transported to the next print engine or to the fixing unit, not shown, where the toner image is fused. The neutralizer 5 is located downstream of the developing unit 13 and upstream of the transfer roller 4 with respect to the rotation of the photoconductive drum 3. The neutralizer 5 illuminates the circumferential surface of the photoconductive drum 3 to neutralize the non-print region of the photoconductive drum 3 where no toner image is formed.

Figure 6:
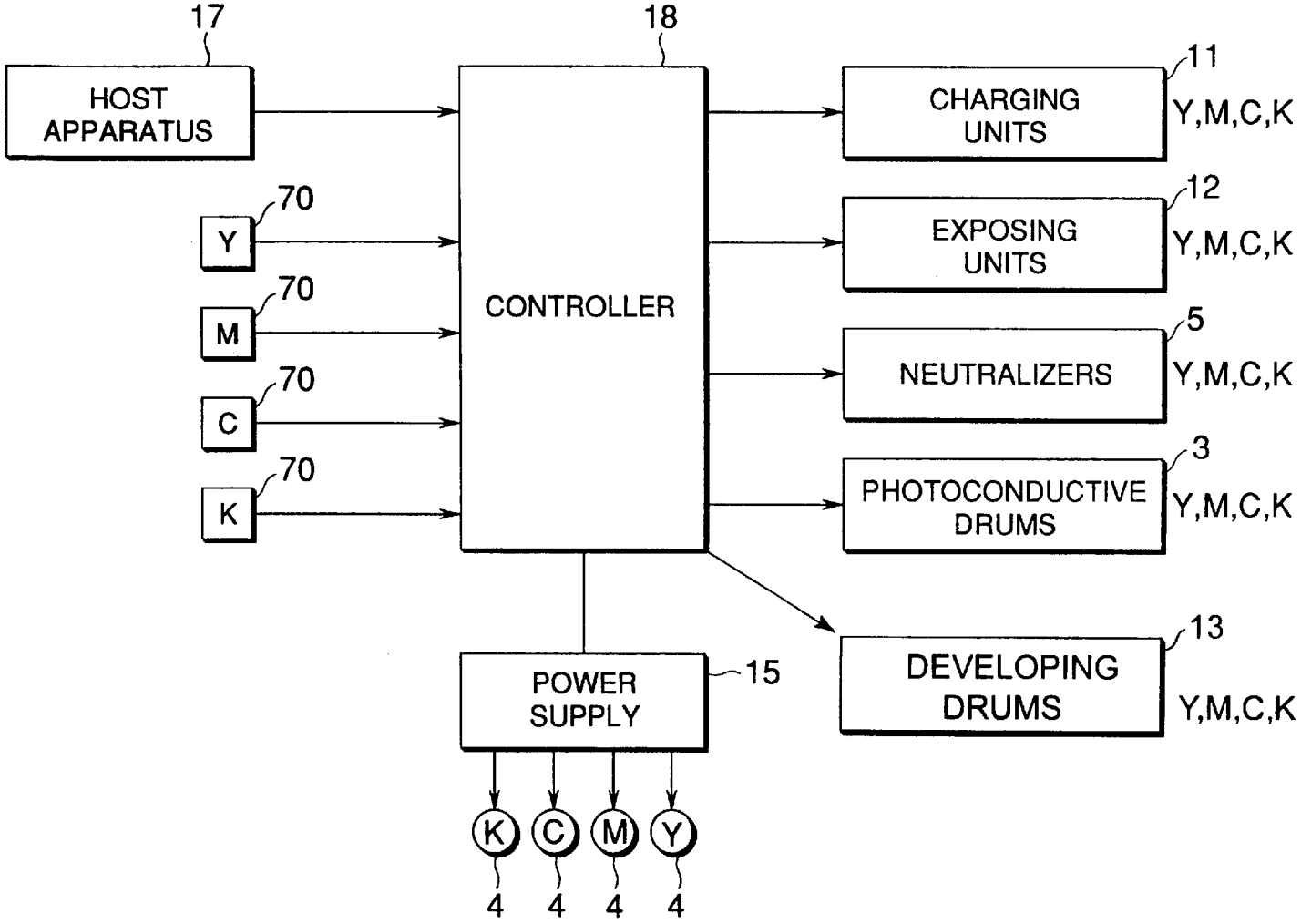
FIG. 6 is a block diagram illustrating an overall control of the printer.

FIG. 6 is a block diagram illustrating an overall control of the printer.

The controller 18 receives the image data from the host apparatus 17 and switches on and off the neutralizers 5 on the basis of the outputs of the sensors 70 for the respective print engines at proper timings. The controller also switches on an off the transfer power supply 15 to supply a transfer voltage to each print engine at proper timings, and controllably drives the charging units 11, exposing units 12, developing units 13, neutralizers 5, and photoconductive drums 3.

Figure 7:
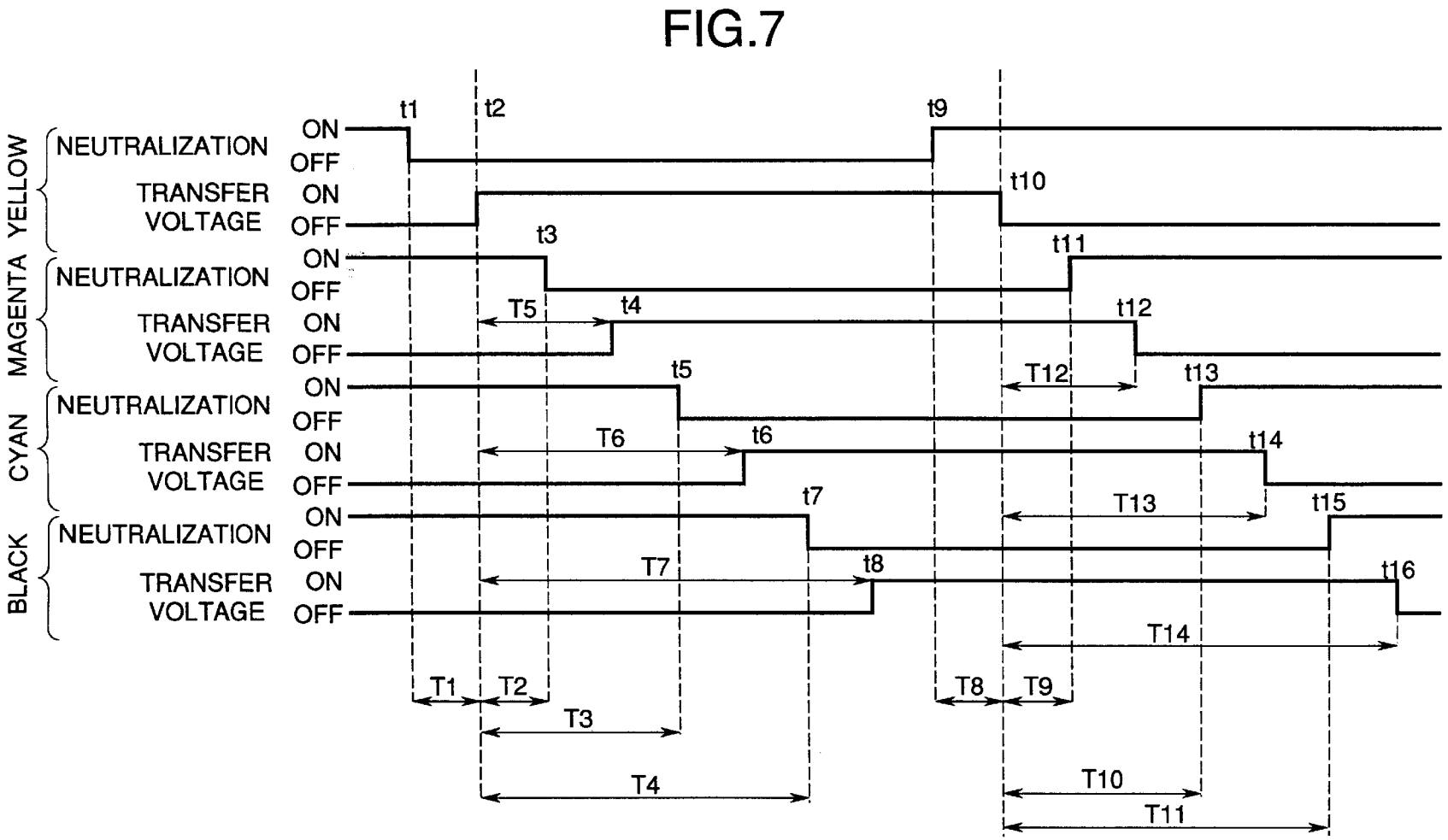
FIG. 7 illustrates a timing chart of a neutralization operation of the aforementioned print engines.
Figure 8:
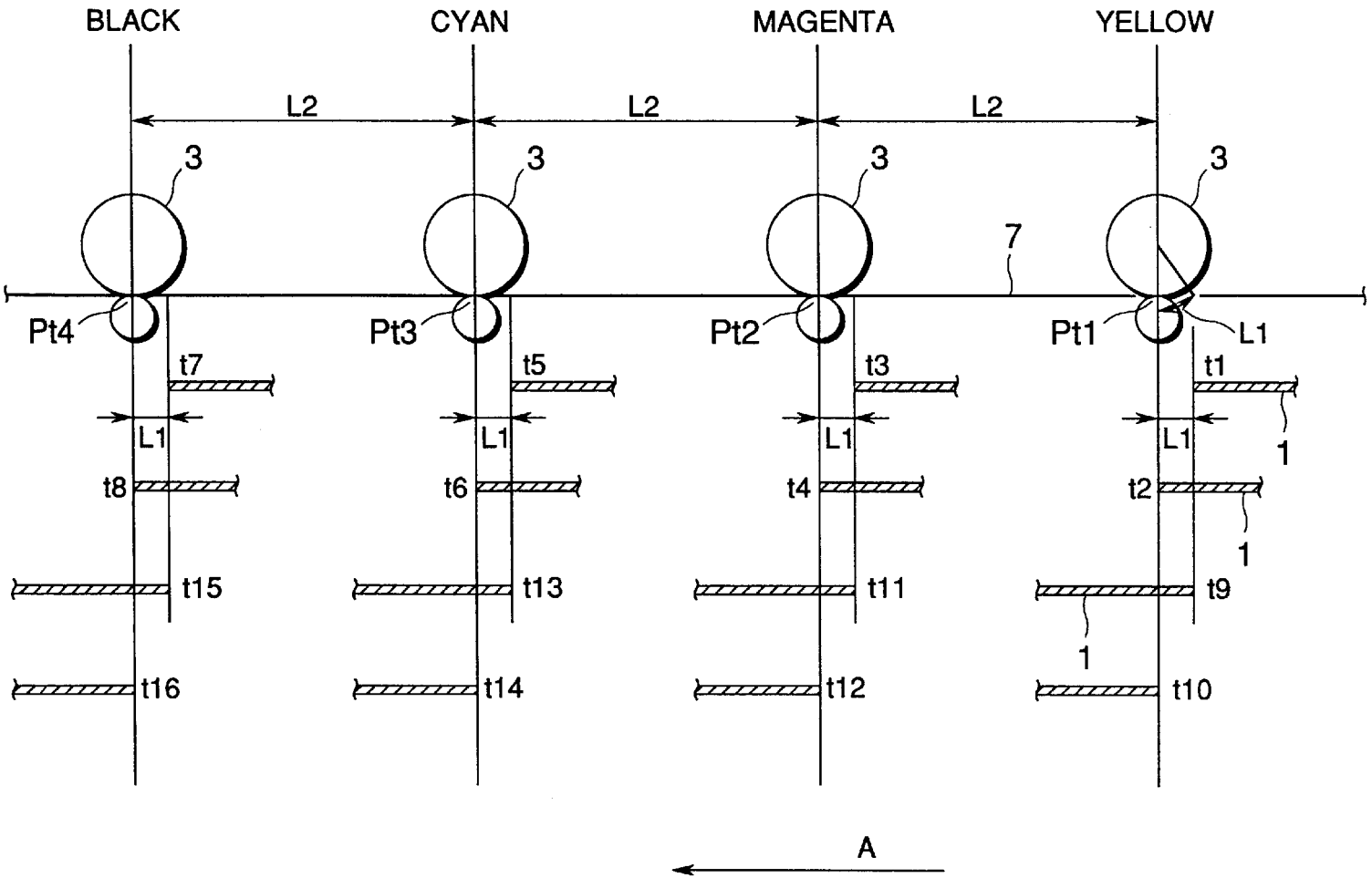
FIG. 8 illustrates relationships among lengths of various times, distances L2 between adjacent print engines, distances L1 between the neutralizer 5, and positions of the print medium, and speed at which the print medium travels.

FIG. 7 illustrates a timing chart of a neutralization operation of the aforementioned print engines for the respective colors. FIG. 8 illustrates the locations of the leading end and trailing end of the print medium at various times.

Referring to FIGS. 7 and 8, at time t1, the neutralizer 5 stops illuminating the photoconductive drum 3. The transfer roller voltage of the yellow print engine rises when the leading end of the print medium 1 arrives at the transfer point P1 at time t2. Shortly after the transfer roller voltage has risen, the leading end of the print medium 1 is pulled in between the photoconductive drum 3 and the transfer roller 4 of the yellow print engine. At time t3, the neutralizer 5 of the magenta print engine stops illuminating the photoconductive drum 3. Likewise, the neutralizers 5 of the respective print engines for cyan and black stop illuminating the corresponding photoconductive drums 3 at times t5 and t7, respectively.

The transfer roller voltages of the respective print engines for magenta, cyan, and black rise at time t4, t6, and t8, respectively. In this manner, the leading end portion of the photoconductive drum 3 is subjected to neutralization except for its print region PR. After having transferred the toner image at the respective print engines, the neutralizers 5 begin to illuminate the trailing end portion of the photoconductive drums at times t9, t11, t13, and t15, respectively. In this manner, the neutralizer 5 illuminates the leading end portion and trailing end portion of the surface on the photoconductive drums 3 before they are actually brought into contact with the leading end portion and trailing end portion of the print medium 1, thereby increasing the surface impedance of the photoconductive drum 3 to suppress changes in the transfer electric field.

Figure 12:
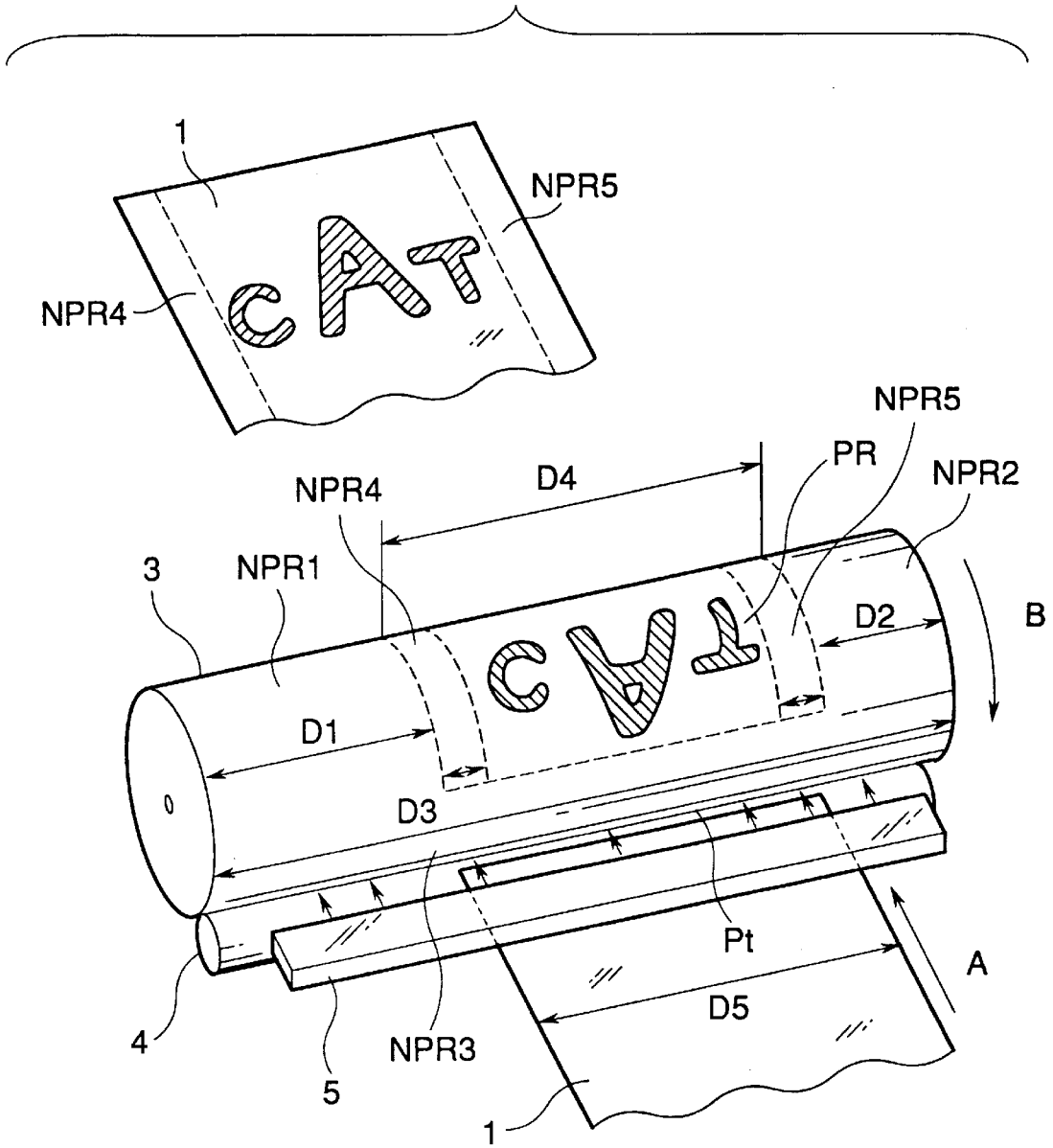
FIG. 12 shows the non-print regions NPR1, NPR2, and NPR3, and print region PR.

FIG. 9 is a table which lists the times at which the leading end and trailing end of the print medium pass the various locations along the transport path, and distances L1 and L2 over which the print medium travels. The leading end and trailing end are detected by the sensors 70. The times t1–t16, elapsed times T1–T14, and distances are shown with respect to times t2 and t10 and the transfer point Pt1 of the yellow print engine. Based on these items of data, the control section of the printer detects the boundaries between the print region PR and non-print region NPR3 on the basis of the output of the sensors 70, thereby controlling the respective neutralizers 5. The boundaries between NPR3 and NPR1–NPR2 (as shown in FIG. 12) are detected on the basis of the location of the leading end and the trailing end of the print medium 1 detected by the sensors 70. The width D4 and non-print regions NPR1 and NPR2 (as shown in FIG. 12) are detected based on the instructions received from the host apparatus.

Figure 10:
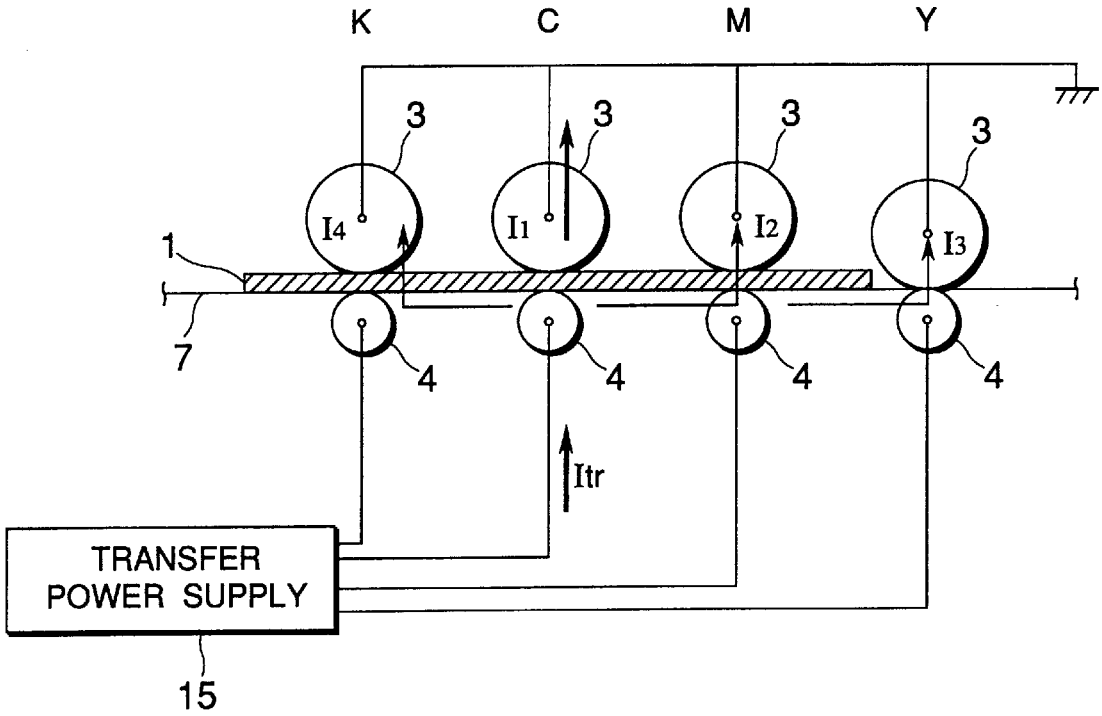
FIG. 10 is an illustrative diagram of a tandem type printer according to the aforementioned invention.

FIG. 10 is an illustrative diagram of a tandem type printer according to the aforementioned invention, showing the transfer operation at the cyan print engine. The positional relation of the print medium 1 with respect to the print engines corresponds to a time period from time t10 to time t12 of FIG. 7. Although transfer operation takes place at the black, cyan, and magenta print engines in FIG. 10, currents are shown only for the transfer operation of the cyan print engine.

Advantages of the invention will be described with reference to FIG. 10. FIG. 10 shows currents when only cyan image is being transferred. The power supply 15 outputs a predetermined voltage to supply the transfer rollers 4 with a transfer current Itr. The impedance of the transfer points Pt at which transfer operation of the toner image takes place is determined by the electrical resistance of the conveyer belt 7, print medium 1, photoconductive drum 3, and transfer roller 4.

In FIG. 10, most (i.e., I1) of the transfer current Itr flows through the print medium 1 into the cyan print engine and leakage currents I2–I4 flow into the magenta, yellow, and black print engines, respectively. It is to be noted that each of the print engines are connected to the power supply 15 so that they are individually energized. It is also to be noted that the print engines are arranged so that the print medium 1 may simultaneously pass two adjacent transfer points Pt. The print medium 1 travels from right to left along the transport path 7 in FIG. 10. As is clear from FIG. 10, the photoconductive drum 3 of the yellow print engine Y has completed its transfer operation and the drum surface has been neutralized. Therefore, the impedance of the drum surface is high, maintaining the current I3 at a reasonably small value. This ensures that transfer potentials at the succeeding print engines are stable. The invention provides more stable transfer potentials for the respective print engines if the photoconductive drums 3 are neutralized in the aforementioned manner than if the photoconductive drums 3 are not neutralized. Moreover, the toner images are not subjected to neutralization, and therefore printing operation can be effected while maintaining high resolution.

Modification 1

Figure 11:
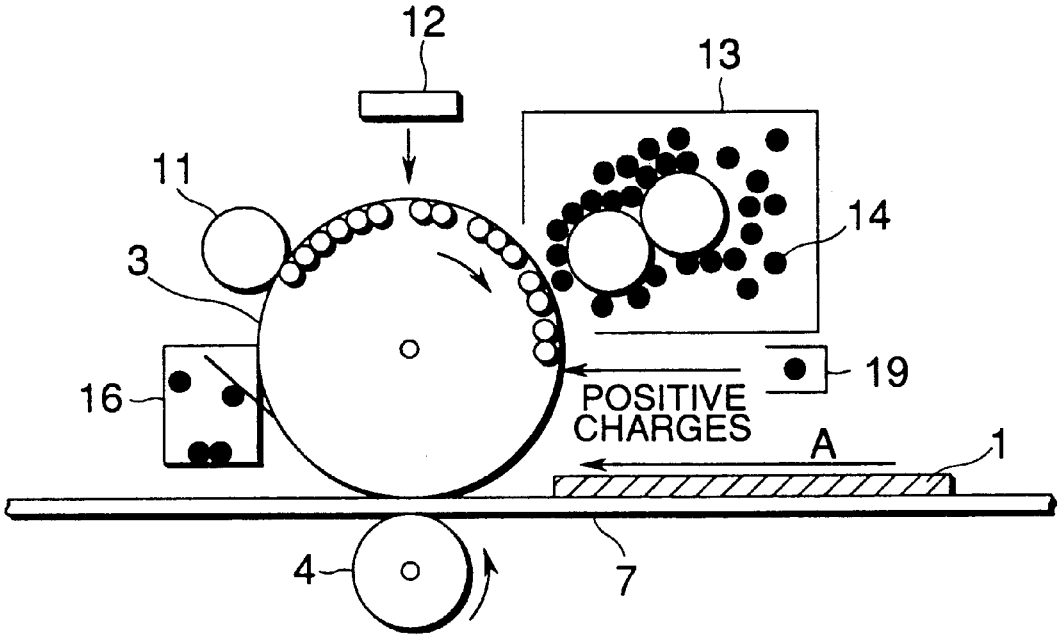
FIG. 11 illustrates a modification of the neutralizer.

FIG. 11 illustrates a modification of the neutralizer.

The construction of a print engine of FIG. 11 is much the same as that of FIG. 5, and differs in that a wire charging source 19 is used in place of the neutralizer 5. The wire charging device 19 is a device which neutralizes the photoconductive drum 3 by injecting charges having a polarity opposite to that of the charged surface of the photoconductive drum 3. The wire charging device 19 functions in a similar manner to light-emitting type neutralizers that use, for example, an LED array. However, illuminating the photoconductive drum 3 with neutralization light can neutralize the surface potential of the photoconductive drum 3 only up to zero volts.

On the other hand, the wire charging device 19 can inject more charges into the photoconductive drum 3 than the light emitting type neutralizer 5, and can therefore adjust the potential of the drum surface at will. The ability to inject more charges increases the impedance of the photoconductive drum 3 even higher. Thus, the difference in potential between the transfer roller 4 and the photoconductive drum 3 decreases, further decreasing the total transfer current Itr.

Modification 2

Figure 14:
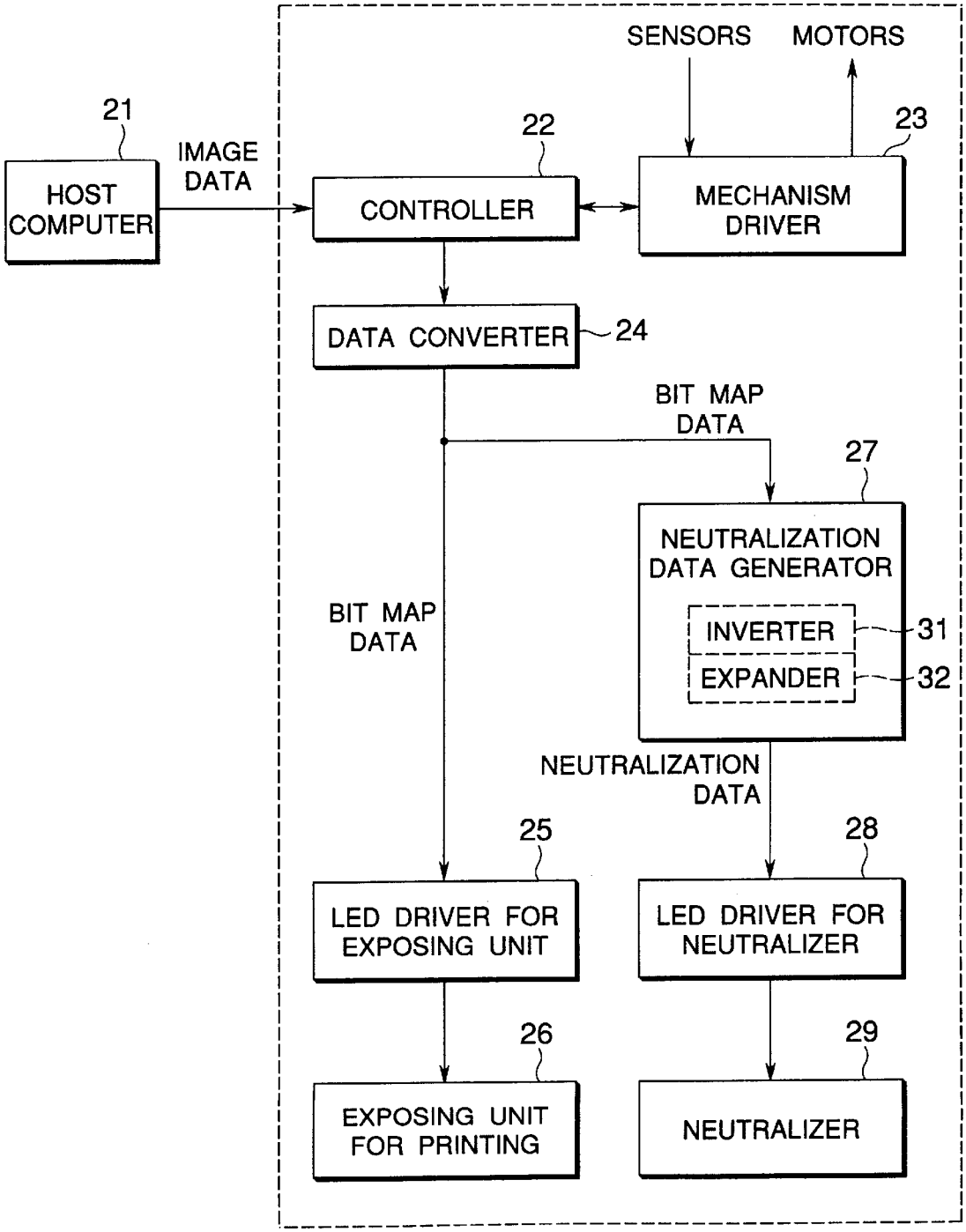
FIG. 14 is a block diagram showing a circuit for producing neutralization data.

FIG. 12 illustrates the positional relationships among the photoconductive drum 3, neutralizer 5 and print medium 1. An electrostatic latent image is formed in a print region PR surrounded by second to third non-print regions NPR1, NPR2, and NPR3. The print region PR has a width D4 which is as wide as that D5 of the print medium 1. The second and second non-print regions NPR1 and NPR2 have widths D1 and D2, while the third non-print region NPR3 has a width D3 that extends across the length of the photoconductive drum 3. The second and second non-print regions NPR1 and NPR2 are detected in terms of the size of the paper cassette or upon instructions received from the host apparatus. The third non-print region NPR3 lies adjacent the leading end and the trailing end of the print region PR, only the NPR3 at the leading end being shown in FIG. 12. Fourth and fifth non-print regions NPR4 and NPR5 may exist depending on the bit map data, lying on both sides of the print region PR. The NPR4 and NPR5 are detected by the neutralization data generator 27 (as shown in FIG. 14) on the basis of the bit map data received from data converter 24 (as shown in FIG. 14).

Just as in the second embodiment, the boundaries between NPR3 and NPR1–NPR2 are detected on the basis of the locations of the leading end and the trailing end of the print medium 1 detected by the sensors 70.

The width D4 and non-print regions NPR1 and NPR2 are detected based on the instructions received from the host apparatus 17. The width D5 of the print medium 1 may be detected based on an instruction from the host apparatus 17 or a detection signal from the paper cassette, not shown. The neutralizer 5 is driven to selectively illuminate the nonprint regions NPR1, NPR2, and NPR3 as the photoconductive drum 3 rotates in a direction shown by arrow B.

Figure 13:
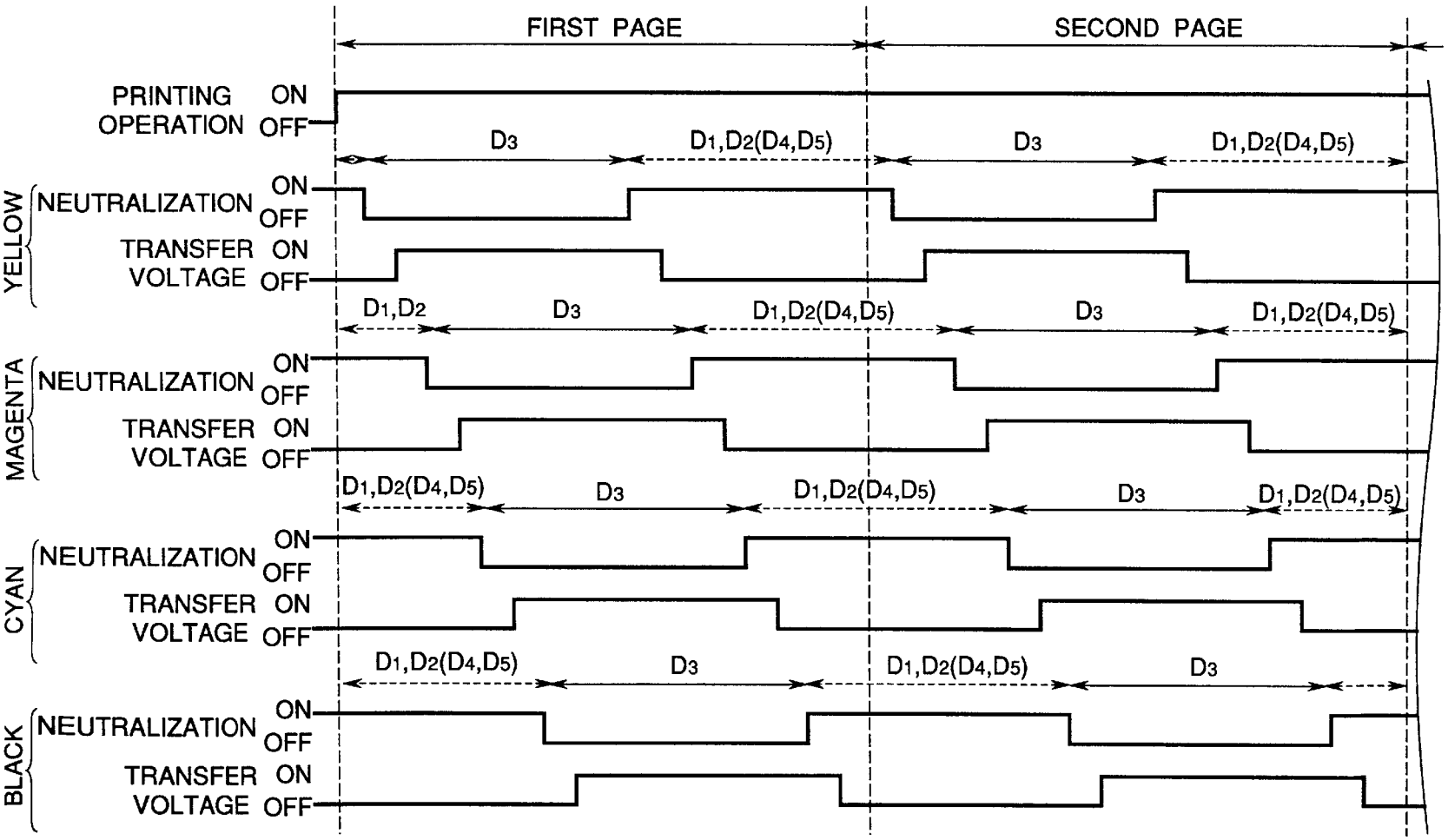
FIG. 13 illustrates timing chart showing the timings at which the non-printing regions NPR 1 (D1), NPR2 (D2), and NPR3 (D3) are neutralized.

FIG. 13 illustrates timing chart showing the timings at which the non-printing regions NPR1 (D1), NPR2 (D2), and NPR3 (D3) are neutralized at the print engines for yellow, magenta, cyan, and black images, the timings being shown for the second and second pages when a continuous printing operation is being performed.

Second Embodiment

The aforementioned first embodiment and the modifications thereof have been described with respect to neutralization operation conducted on a non-print region of the photoconductive drum 3 where no toner image exists. However, in reality, there are some cases where a toner image occupies only limited areas of the print medium 1 and large areas of the print medium 1 are left not printed. If such non-printed areas can be neutralized, the impedance of the photoconductive drum 3 can be made significantly high.

In the second embodiment, non-printed areas are searched in effect all across an area on the photoconductive drum corresponding to the print medium 1 on the basis of the bit map data to produce neutralization data.

FIG. 14 is a block diagram showing a circuit for producing neutralization data.

A host computer 21 is connected to the printer and outputs image data to the printer. The printer includes a controller 22, a mechanism driver 23, a data converter 24, a LED driver 25, an exposing unit 26, a neutralization data generator 27, an LED driver 28, and a neutralizer 29. The neutralization data generator 27 is a section which produces the neutralization data.

The functions and operations of the various sections will be described in detail.

The mechanism driver 23 is a circuit which controllably drives the photoconductive drum 3 and other mechanisms in the printer. The mechanism driver 23 receives the outputs of the sensors 70. The data converter 24 converts the image data, received and stored in the controller 22, into bit map data. The bit map data is supplied from the data converter 24 to the exposing unit 26 via the LED driver 25. The exposing unit 26 takes the form of a well known LED array similar to the exposing unit 12 of FIG. 11. The LEDs of the exposing unit 26 are individually energized in accordance with the bit map data to form an electrostatic latent image on the circumferential outer surface of the photoconductive drum 3.

The neutralization data generator 27 receives the bit map data from the data converter 24 and produces neutralization data which will be described later. The neutralizer 29 is constructed in the same way as the exposing unit 26 and is located at a location similar to the neutralizer 5 of FIG. 5, i.e., downstream of the developing unit 13 and upstream of the transfer roller 4 with respect to the rotation of the photoconductive drum 3. The neutralizer 29 selectively illuminates areas of the photoconductive drum 3 except for areas which are occupied by the toner, thereby neutralizing all areas which are not occupied by the toner.

Figure 15:
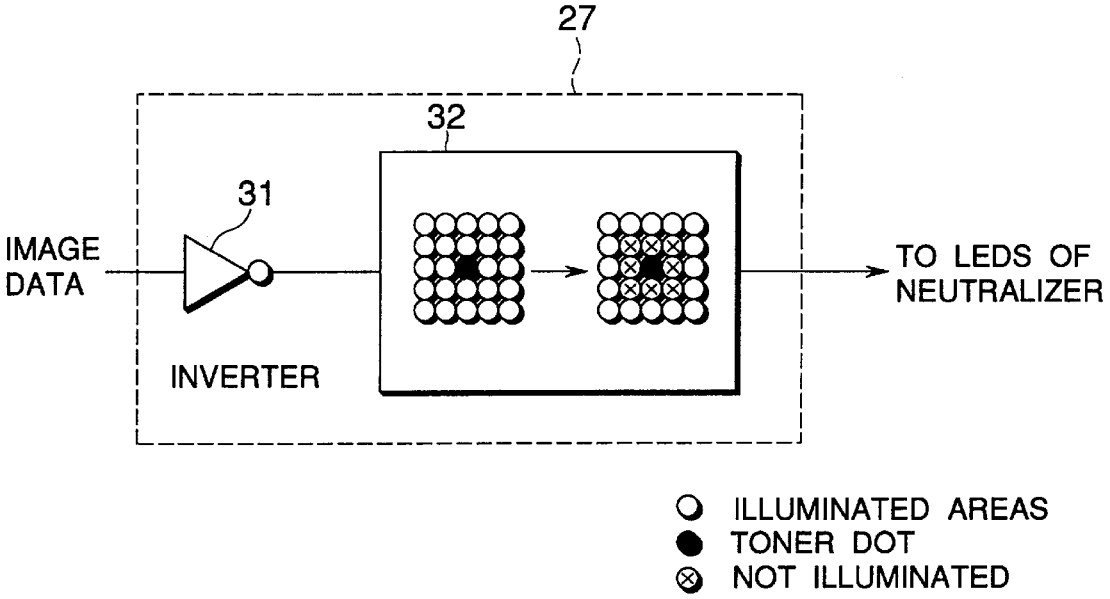
FIG. 15 illustrates the operation of the neutralization data generator.

FIG. 15 illustrates the operation of the neutralization data generator 27.

The neutralization data generator 27 includes an inverter 31 and expander 32. The inverter 31 inverts the bits of bit map data received from the data converter 24. This inverting operation resembles inversion from positive to negative in photography process. The expander 32 produces a signal for illuminating areas shown by white circles which surround a toner dot (black circle). In this example, the signal drives the neutralizer 29 to illuminate the surface of the photoconductive drum 3 except areas directly surrounding the toner dot, i.e., areas shown by circles having crosses therein. The operation of the expander 32 will be described in more detail with reference to FIGS. 16A–16B.

Figure 16A:
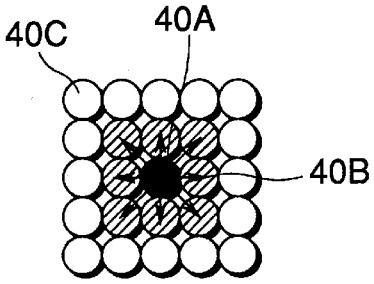
FIGS. 16A and 16B show neutralization area and a buffer area, FIG. 16A showing a single toner dot and FIG. 16B showing a plurality of toner dots.
Figure 16B:
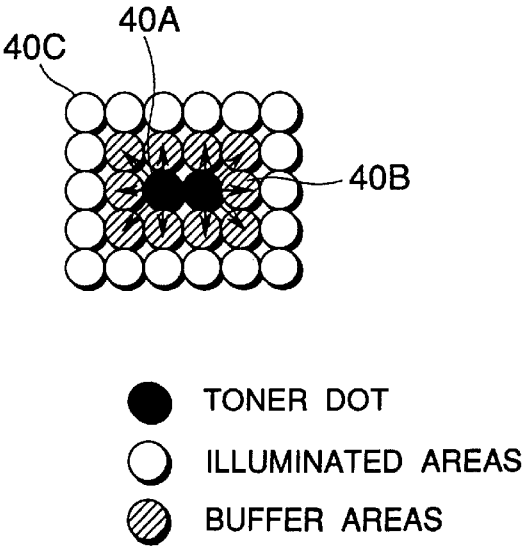

FIGS. 16A and 16B show the positional relation between a neutralization area 40C and a buffer area 40B, FIG. 16A showing a case of a single toner dot and FIG. 16B showing a case of successive two toner dots. The black circles 40A show a toner dot(s). The buffer area 40B is shown by hatched circles and has a one-dot width. The buffer area 40B surrounds the toner dots. In other words, the buffer area 40B is an area of the black dot expanded in vertical, horizontal, and diagonal directions with respect to the black dot(s). The buffer area 40B is shown by hatched circles and is not neutralized. The buffer area 40B forms a guard area to ensure that the toner dots are not illuminated by accident, preventing the toner image from being deformed or dropping from the surface of the photoconductive drum 3. The buffer area 40B is effective in improving print quality. The buffer area 40B may be eliminated if neutralization around the toner image can be performed with greater dimensional accuracy.

Figure 17:
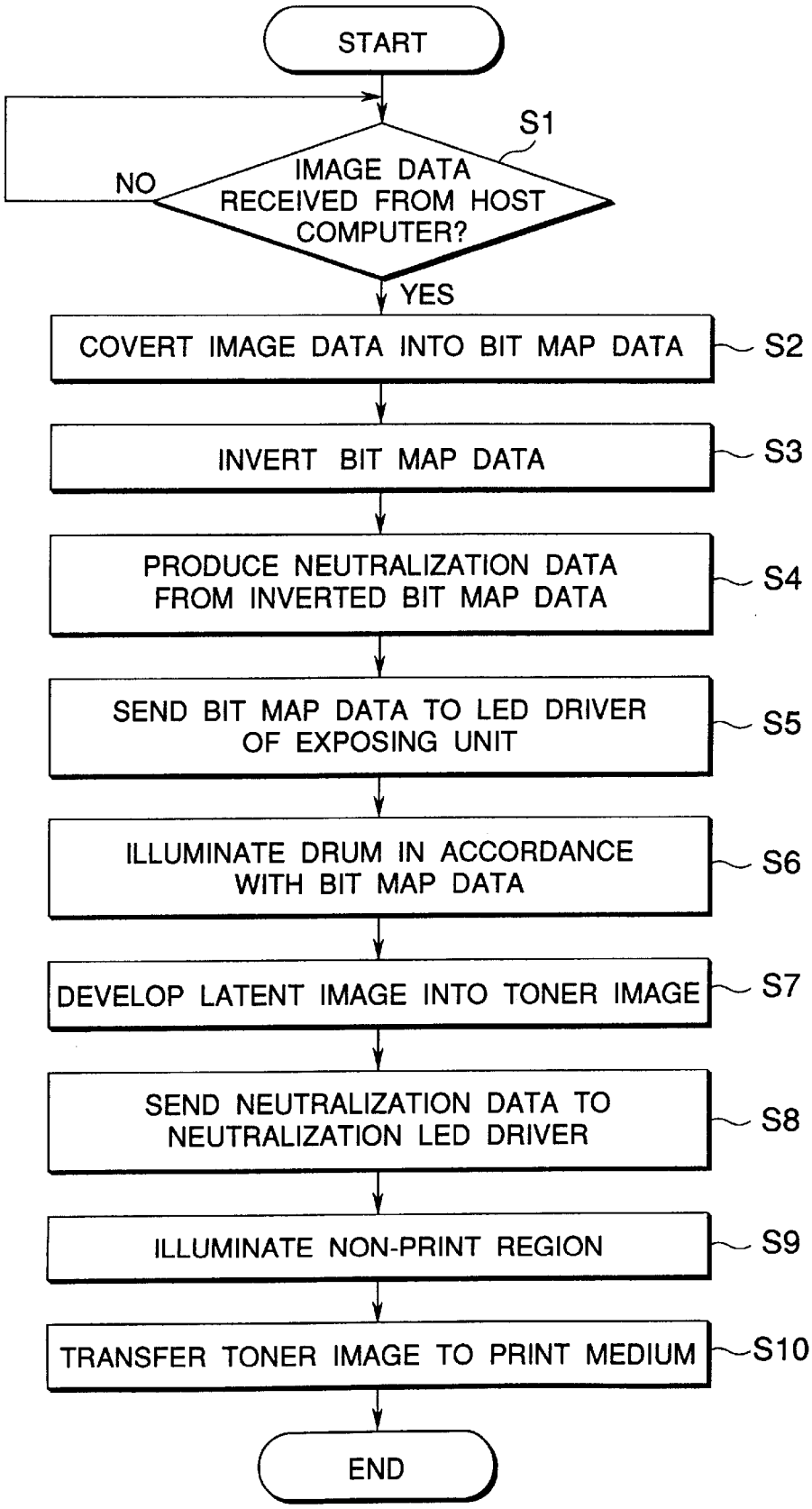
FIG. 17 is a flowchart illustrating the aforementioned neutralization operation.

FIG. 17 is a flowchart illustrating the aforementioned neutralization operation.

At step S1, a check is made to determine whether the controller 22 has received image data from the host computer. At step S2, the data converter 24 converts the image data into bit map data. At step S3, the bit map data is inverted by the inverter 31. At step S4, the neutralization data having buffer areas is produced on the basis of the inverted bit map data, the buffer area being an area surrounding the black dots in the vertical, horizontal, and diagonal directions. At step S5, the bit map data produced at step S2 is sent to the LED driver 25. At step S6, the surface of the photoconductive drum 3 is illuminated by the exposing unit 26 in accordance with the bit map data to form an electrostatic latent image on the surface of the photoconductive drum 3. At step S7, the electrostatic latent image is developed by the developing unit 13 into a toner image. At step S8, the neutralization data produced at step S4 is sent to the LED driver 28. At step S9, the non-print region on the photoconductive drum 3 is illuminated by the neutralizer 29. This completes neutralization operation. At step S10, the toner image is transferred from the photoconductive drum 3 to the print medium 1.

Producing Neutralization Data

The production of the neutralization data will be described with reference to FIGS. 18–20.

Figure 18:
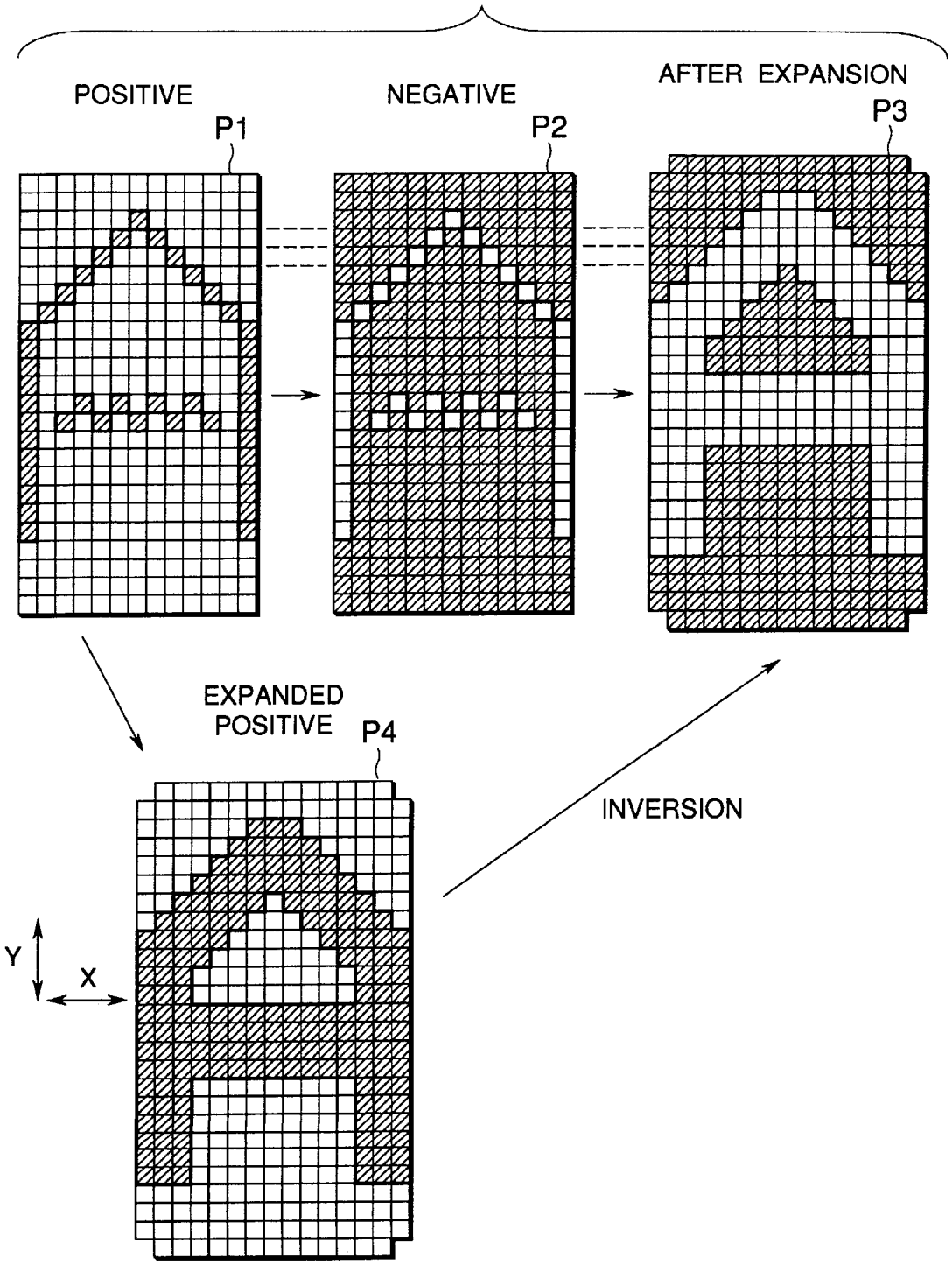
FIG. 18 illustrates a second method of producing the neutralization data.

FIG. 18 illustrates a second method of producing the neutralization data.

Referring to FIG. 18, an original positive picture P1 is a segment of bit map data which is used to form an electrostatic latent image. The positive picture P1 is inverted by the inverter 31 into a negative picture P2 where black dots have been converted into white dots and white dots have been converted into black dots.

Then, the white areas of the negative picture P2 are expanded or thickened by one dot in the vertical, horizontal, and diagonal directions around the white areas by the expander 32, thereby producing a picture P3. The increased white areas define the buffer area and the black areas of P3 are areas which are illuminated by the LEDs of the neutralizer 29. The white dots of P3 are areas which are not illuminated by the LEDs of the neutralizer 29.

Alternatively, the original positive picture P1 may be second expanded by one dot in vertical, horizontal, and diagonal directions, thereby producing an expanded positive P4. Then, the picture P4 may be inverted into the picture P3.

FIGS. 19A–19D illustrate how the picture P2 is expanded in vertical, horizontal, and diagonal directions into picture P3.

Figures 19A, 19B, 19C, 19D:
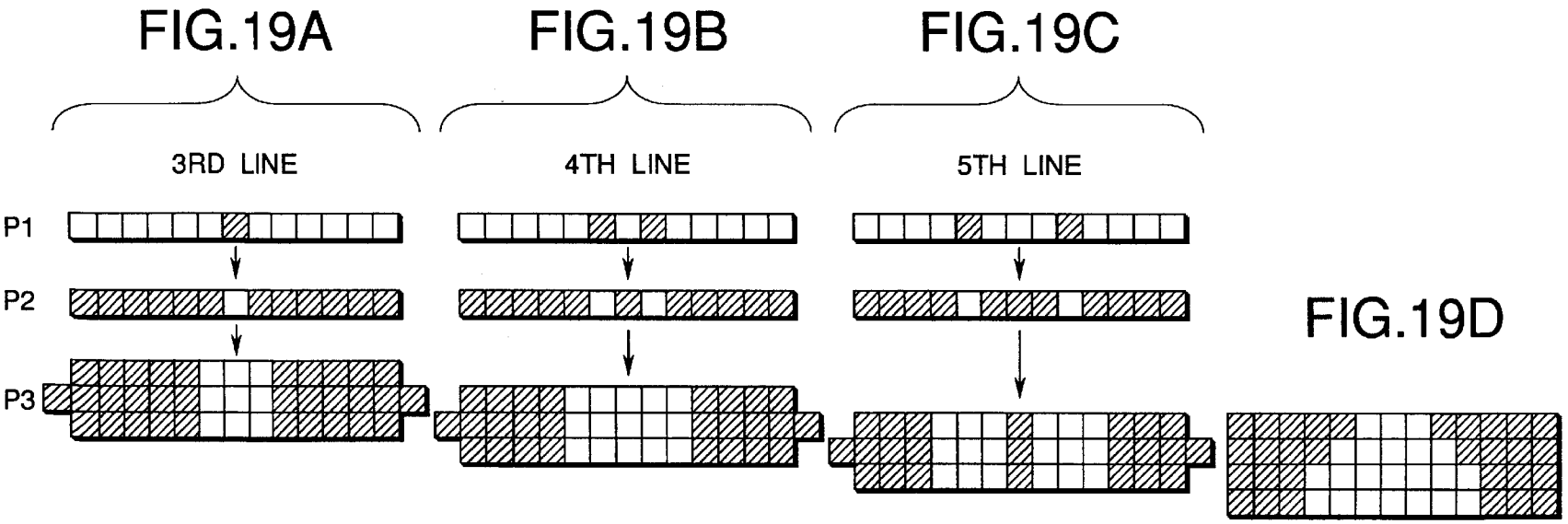
FIGS. 19A–19D illustrate how the picture P1 is expanded in vertical, horizontal, and diagonal directions.

FIG. 19A shows, by way of example, the third line from the top of the picture P1 of FIG. 18. The third line is inverted and then expanded by one dot in vertical, horizontal, and diagonal directions, thereby a single white dot being increased to 9 white dots. FIG. 19B shows the fourth line from the top of the picture P1. The fourth line is inverted and then expanded by one dot in vertical, horizontal, and diagonal directions, so that the two white dots are increased to 15 dots. Likewise, FIG. 19C shows the fifth line from the top of the positive picture P1. The fifth line is expanded in vertical, horizontal, and diagonal directions, so that the two white dots are increased to two groups of 9 dots. The expanded picture P3 of 3rd, 4th, and 5th lines are shifted by one line and are superposed one over the other, thereby forming a resultant expanded picture P3 in FIG. 19D.

FIGS. 20A–20D illustrate the digital representations of the 2nd to 5th lines, respectively, after they have been expanded in vertical, horizontal, and diagonal directions.

FIG. 20A shows the digital representation of the 2nd line. Since there is no dot in the 2nd line, all of the bits are of a logic level "1".

The expanded digital representations are ANDed to produce ultimate neutralization data for each line. For example, the digital data for the third line shown in FIGS. 20A, 20B, and 20C are ANDed to produce ultimate data (1111000001111) for the third line shown in FIG. 20. Likewise, the digital data for the fourth line shown in FIG. 20B, 20C, and 20D are ANDed to produce ultimate data (1110000000111) for the fourth line shown in FIG. 20F. The ultimate data can be used as neutralization data to neutralize only limited areas in the print region on the photoconductive drum 3. While the aforementioned example has been described with respect to a segment of the print data, the neutralization data can also be produced on a line-by-line basis. Further, the neutralization data may be produced in any other reasonable forms.

The aforementioned neutralization operation may be applied not only to a tandem type color electrophotographic printer but also to a monochrome electrophotographic printer.

The present invention is particularly effective when it is applied to a tandem type electrophotographic printer where a print medium travels along the transport path while simultaneously contacting a plurality of photoconductive drums and having toner images transferred thereon.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electrophotographic printer, comprising:

a rotatable photoconductive drum having a surface on which an electrostatic latent image is formed in a second area in accordance with bit map data;

a developing unit disposed along said photoconductive drum, said developing unit applying toner to the first area and developing the electrostatic latent image into a toner image with the applied toner;

a transfer device disposed downstream of said developing unit with respect to rotation of said photoconductive drum, said transfer device transferring the toner image to a print medium when the print medium travels along a transport path past a transfer point where the print medium is sandwiched between said photoconductive drum and said transfer device;

a neutralizer disposed downstream of said developing unit and upstream of said transfer device, said neutralizer neutralizing a second area of said surface of said photoconductive drum, the second area being separate from the first area; and a non-print region detector provided along the transport path, said non-print region detector outputting a detection signal upon detecting a leading end and upon detecting a trailing end of the print medium passing along the transport path;

wherein said neutralizer neutralizes the second area on the photoconductive drum adjacent to the leading end and the trailing end of the print medium in accordance with the detection signal.

2. An electrophotographic printer comprising:

a rotatable photoconductive drum having a surface on which an electrostatic latent image is formed in a second area in accordance with bit map data;

a developing unit disposed along said photoconductive drum, said developing unit applying toner to the second area and developing the electrostatic latent image into a toner image with the applied toner;

a transfer device disposed downstream of said developing unit with respect to rotation of said photoconductive drum, said transfer device transferring the toner image to a print medium when the print medium travels along a transport path past a transfer point where the print medium is sandwiched between said photoconductive drum and said transfer device;

a neutralizer disposed downstream of said developing unit and upstream of said transfer device, said neutralizer neutralizing a second area of said surface of said photoconductive drum, the second area being separate from the first area; and a neutralization data generator, said neutralization data generator searching the bit map data for dots which should be printed, and producing neutralization data on the basis of the dots;

wherein said neutralizer illuminates only the second area in accordance with the neutralization data, wherein said neutralization data generator inverts the bit map data to produce the neutralization data, and wherein said neutralizer includes light emitting elements energized in accordance with the neutralization data to illuminate the second area.

3. An electrophotographic printer, comprising:

a rotatable photoconductive drum having a surface on which an electrostatic latent image is formed in a first area in accordance with bit map data;

a developing unit disposed along said photoconductive drum, said developing unit applying toner to the first area and developing the electrostatic latent image into a toner image with the applied toner;

a transfer device disposed downstream of said developing unit with respect to rotation of said photoconductive drum, said transfer device transferring the toner image to a print medium when the print medium travels along a transport path past a transfer point where the print medium is sandwiched between said photoconductive drum and said transfer device;

a neutralizer disposed downstream of said developing unit and upstream of said transfer device, said neutralizer neutralizing a second area of said surface of said photoconductive drum, the second area being separate from the first area; and a neutralization data generator, said neutralization data generator searching the bit map data for dots which should be printed, and producing neutralization data on the basis of the dots;

wherein said neutralizer illuminates only the second area in accordance with the neutralization data; and wherein said neutralization data generator produces the neutralization data such that a non-illuminated, non-neutralized buffer area having a predefined width surrounds the first area.

4. An electrophotographic printer comprising:

a rotatable photoconductive drum having a surface on which an electrostatic latent image is formed in a second area in accordance with bit map data;

a developing unit disposed along said photoconductive drum, said developing unit applying toner to the second area and developing the electrostatic latent image into a toner image with the applied toner;

a transfer device disposed downstream of said developing unit with respect to rotation of said photoconductive drum, said transfer device transferring the toner image to a print medium when the print medium travels along a transport path past a transfer point where the print medium is sandwiched between said photoconductive drum and said transfer device; and a neutralizer disposed downstream of said developing unit and upstream of said transfer device, said neutralizer neutralizing a second area of said surface of said photoconductive drum, the second area being separate from the first area;

wherein said photoconductive drum is one of a plurality of photoconductive drums of said printer, said plurality of photoconductive drums being aligned in tandem along the transport so that different images may be transferred in registration with each other on the print medium as the print medium travels along the transport path; and wherein said plurality of photoconductive drums are arranged so that the print medium may simultaneously pass two adjacent transfer points.

5. An electrophotographic printer, comprising:

a rotating photoconductive drum having a photoconductive surface;

a charging unit, charging said photoconductive surface;

an exposing unit disposed downstream of said charging unit with respect to rotation of said photoconductive drum, said exposing unit illuminating a first area of said photoconductive surface to form an electrostatic latent image in accordance with bit map data supplied thereto;

a developing unit disposed downstream of said exposing unit, said developing unit developing the electrostatic latent image with toner into a toner image;

a transfer device disposed downstream of said developing unit, with said transfer device in opposition to said photoconductive surface so as to define a transfer point therebetween, wherein a print medium traveling along a transport path is sandwiched between said photoconductive drum and said transfer device at the transfer point, said transfer device transferring the toner image to the print medium at the transfer point; and a neutralizer provided downstream of said developing unit and upstream of said transfer device, said neutralizer electrically neutralizing a second area of said photoconductive surface, the second area not being illuminated by said exposing unit when the electrostatic latent image is formed in the second area of said photoconductive surface, the second area being neutralized during a period between development of the electrostatic latent image and the transfer of the toner image to the print medium.

6. The electrophotographic printer according to claim 5 further comprising:

a neutralization data generator, said neutralization data generator searching the bit map data for dots which should be printed, and producing neutralization data on the basis of the dots;

wherein said neutralizer illuminates only the second area in accordance with the neutralization data.

7. The electrophotographic printer according to claim 6, wherein said neutralization data generator inverts the bit map data to produce the neutralization data and said neutralizer includes light emitting elements energized in accordance with the neutralization data to illuminate the second area.

8. The electrophotographic printer according to claim 5, wherein said photoconductive drum is one of a plurality of photoconductive drums of said printer, said plurality of photoconductive drums being aligned in tandem along the transport path so that different images may be transferred in registration with each other on the print medium as the print medium travels along the transport path.

9. The electrophotographic printer according to claim 8, wherein said plurality of photoconductive drums are arranged so that the print medium may simultaneously pass two adjacent transfer points.

10. The electrophotographic printer according to claim 5, further comprising:

a non-print region detector provided along the transport path, said non-print region detector detecting a leading end and a trailing end of the print medium when the print medium is passing along the transport path; wherein upon detection of each the leading end and the trailing end, said non-print region detector outputs a detection signal; and wherein said neutralizer neutralizes the second area on said photoconductive surface adjacent to the leading end and the trailing end of the print medium in accordance with the detection signal.

11. The electrophotographic printer according to claim 5, wherein said neutralization data generator produces the neutralization data such that a non-illuminated, non-neutralized buffer area having a predefined width surrounds the second area.

* * * * *